US007693587B2

(12) United States Patent
Barhen et al.

(10) Patent No.: US 7,693,587 B2
(45) Date of Patent: Apr. 6, 2010

(54) CONTROL OF FRICTION AT THE NANOSCALE

(75) Inventors: Jacob Barhen, Oak Ridge, TN (US); Yehuda Y. Braiman, Oak Ridge, TN (US); Vladimir Protopopescu, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 694 days.

(21) Appl. No.: 10/770,857

(22) Filed: Feb. 3, 2004

(65) Prior Publication Data

US 2010/0042266 A1 Feb. 18, 2010

(51) Int. Cl.

| | |
|---|---|
| ***G05B 13/02*** | (2006.01) |
| ***G05B 19/08*** | (2006.01) |
| ***G05B 11/32*** | (2006.01) |
| ***G01P 15/00*** | (2006.01) |
| ***B23K 9/00*** | (2006.01) |

(52) U.S. Cl. ..... 700/45; 73/488; 219/121.36; 219/121.42; 700/63; 700/69

(58) Field of Classification Search ..... 700/1, 700/40, 261, 45, 63, 69; 73/488; 219/121.36, 219/121.42

See application file for complete search history.

(56) References Cited

U.S. PATENT DOCUMENTS

| | | | | |
|---|---|---|---|---|
| 5,347,854 | A * | 9/1994 | Martin et al. | 73/105 |
| 5,371,669 | A * | 12/1994 | Venkataraman et al. | 700/40 |
| 6,418,776 | B1 | 7/2002 | Gitis et al. | |
| 6,597,048 | B1 | 7/2003 | Kan | |
| 2002/0064341 | A1 * | 5/2002 | Fauver et al. | 385/25 |
| 2002/0115164 | A1 * | 8/2002 | Wang et al. | 435/173.9 |
| 2002/0121443 | A1 * | 9/2002 | O'Connell | 204/547 |
| 2002/0132315 | A1 * | 9/2002 | Wang et al. | 435/173.1 |
| 2003/0049381 | A1 * | 3/2003 | Mirkin et al. | 427/402 |
| 2003/0139907 | A1 * | 7/2003 | McCarthy | 702/183 |
| 2003/0173869 | A1 * | 9/2003 | Kato et al. | 310/328 |
| 2003/0189030 | A1 * | 10/2003 | Faour | 219/121.7 |
| 2004/0031776 | A1 * | 2/2004 | Gevelber et al. | 219/121.36 |
| 2004/0121474 | A1 * | 6/2004 | SooHoo et al. | 436/63 |

(Continued)

OTHER PUBLICATIONS

"Trust: A Deterministic Algorithm for Global Optimization"; Jacob Barhen, Vladimir Protopopescu and David Reister; Science,; vol. 276; May 16, 1997; pp. 1094-1097.*

(Continued)

*Primary Examiner*—Albert DeCady
*Assistant Examiner*—Jennifer L Norton
(74) *Attorney, Agent, or Firm*—Brinks Hofer Gilson & Lione

(57) ABSTRACT

Methods and apparatus are described for control of friction at the nanoscale. A method of controlling frictional dynamics of a plurality of particles using non-Lipschitzian control includes determining an attribute of the plurality of particles; calculating an attribute deviation by subtracting the attribute of the plurality of particles from a target attribute; calculating a non-Lipschitzian feedback control term by raising the attribute deviation to a fractionary power $\xi=(2m+1)/(2n+1)$ where n=1, 2, 3 . . . and m=0, 1, 2, 3 . . . , with m strictly less than n and then multiplying by a control amplitude; and imposing the non-Lipschitzian feedback control term globally on each of the plurality of particles; imposing causes a subsequent magnitude of the attribute deviation to be reduced.

26 Claims, 2 Drawing Sheets

U.S. PATENT DOCUMENTS

2004/0228374 A1* 11/2004 Inukai ..... 372/31
2006/0164104 A1* 7/2006 Tada et al. ..... 324/646

OTHER PUBLICATIONS

"Control Friction at the Nanoscale"; Y. Braiman; J. Barhen and V. Protopopescu; Physical Review Letters; The American Physcial Society; vol. 90, No. 9; Mar. 7, 2003; pp. 1-4.*
"Terminal Model of Newtonian Dynamics", Michail Zak, International Journal of Theoretical Physics, vol. 32, No. 1, (1993), pp. 159-190.*
"Non-Lipschitz Approach to Quantum Mechanics"; Michail Zak, Chaos, Solitons and Fractals, vol. 9, No. 7, (Jul. 1, 1998), pp. 1183-1198.*
Bair, S. et al., "Comparison of Nonequilibrium Molecular Dynamics with Experimental Measurements in the Nonlinear Shear-Thinning Regime," *Phys. Rev. Lett.*, vol. 88, No. 5, 2002, pp. 058302-1 to 058302-4.
Barhen, J. et al., "Neural Learning of Constrained Nonlinear Transformations," *IEEE*, 1989, pp. 67-76.
Batista, A. A. et al., "Bifurcations from steady sliding to stick slip in boundary lubrication," *Phys. Rev. E.*, vol. 57, No. 5, 1998, pp. 4986-4996.
Bhushan, B. et al., "Nanotribology and Nanomechanics of MEMS Devices," *IEEE*, 1996, pp. 91-98.
Bhushan, B. et al., "Nanotribology: friction, wear and lubrication at the atomic scale," *Nature*, vol. 374, 1995, pp. 607-616.
Braiman, Y. et al., "Array-enhanced friction in the periodic stick-slip motion of nonlinear oscillators," *Phys. Rev. E.*, 3rd Ser., vol. 53, No. 4, Part A, 1996, pp. R3005-R3008.
Braiman, Y. et al., "Control of Friction at the Nanoscale," *Phys. Rev. Lett.*, vol. 90, No. 9, 2003, pp. 094301-1 to 094301-4.
Braiman, Y. et al., "Nonlinear friction in the periodic stick-slip motion of coupled oscillators," *Phys. Rev. B.*, vol. 55, No. 8, 1997, pp. 5491-5504.
Braiman, Y. et al., "Tuning friction with noise and disorder," *Phys. Rev. E.*, vol. 59, No. 5, 1999, pp. R4737-R4740.
Carlson, J. M. et al., "Constitutive relation for the friction between lubricated surfaces," *Phys. Rev. E.*, vol. 53, No. 4, 1996, 4153-4165.
Daly, C. et al., "Sliding Friction of Solid Xenon Monolayers and Bilayers on Ag(111)," *Phys. Rev. Lett.*, vol. 76, No. 5, 1996, pp. 803-806.
Demirel, A. L. et al., "Friction Fluctuations and Friction Memory in Stick-Slip Motion," *Phys. Rev. Lett.*, vol. 77, No. 21, 1996, pp. 4330-4333.
Elmer, F-J., "Nonlinear dynamics of dry friction," *Journal of Physics A: Mathematical and General*, vol. 30, 1997, pp. 6057-6063.
Fujita, H., "A Decade of MEMS and Its Future," *IEEE*, 1997, pp. 1-8.
Gao, J. et al., "Friction Control in Thin-Film Lubrication," *The Journal of Physical Chemistry B*, vol. 102, No. 26, 1998, pp. 5033-5037.
Gao, J. et al., "Structures, solvation forces and shear of molecular films in a rough nano-confinement," *Trilogy Letters*, vol. 9, 2000, pp. 3-13.
Hentschel, H. G. E. et al., "Friction Selection in Nonlinear Particle Arrays," *Phys. Rev. Lett.*, vol. 83, No. 1, 1999, pp. 104-107.
Heuberger, M. et al., "Coupling of Normal and Transverse Motions during Frictional Sliding," *The Journal of Physical Chemistry B.*, vol. 102, No. 26, 1998, pp. 5038-5041.
Hu, Y-Z. et al., "Microscopic study of thin film lubrication and its contributions to macroscopic tribology," *Tribology Letters*, vol. 5, 1998, pp. 81-88.
Landman, U. et al., "Atomic-Scale Issues in Tribology: Interfacial Junctions and Nano-elastohydrodynamics," *Langmuir*, vol. 12, No. 19, 1996, pp. 4514-4528.
Mak, C. et al., "Quartz-crystal microbalance studies of the velocity dependence of interfacial friction," *Phys. Rev. B.*, vol. 58, No. 9, 1998, pp. 5157-5159.
Persson, B.N.J., et al., "Linear sliding friction: on the origin of the microscopic friction for Xe on silver," *Surface Science*, vol. 367, 1996, pp. 261-275.
Persson, B. N. J., "Theory of friction and boundary lubrication," *Phys. Rev. B.*, vol. 48, No. 24, 1993, pp. 18140-18158.
Persson, B. N. J., "Theory of friction: Dynamical phase transitions in adsorbed layers," *Journal of Chemical Physics*, vol. 103, No. 9, 1995, pp. 3849-3860.
Persson, B. N. J., "Theory of friction: Friction dynamics for boundary lubricated surfaces," *Phys. Rev. B.*, vol. 55, No. 12, 1997, pp. 8004-8012.
Reiter, G. et al., "From Static to Kinetic Friction in Confined Liquid Films," *Science*, vol. 263, 1994, pp. 1741-1744.
Rozman, M. G. et al., "Controlling chaotic frictional forces," *Phys. Rev. E.*, vol. 57, No. 6, 1998, pp. 7340-7343.
Rozman, M. G. et al., "Origin of stick-slip motion in a driven two-wave potential," *Phys. Rev. E.*, vol. 54, No. 6, 1996, pp. 6485-6494.
Rozman, M. G. et al, "Stick-Slip Motion and Force Fluctuations in a Driven Two-Wave Potential," *Phys. Rev. Lett.*, vol. 77, No. 4, 1996, pp. 683-686.
Smith, E. D. et al., "Friction on adsorbed monolayers," *Phys. Rev. B.*, vol. 54, No. 11, 1996, pp. 8252-8260.
Sokoloff, J. B., "Theory of the contribution to sliding friction from electronic excitations in the microbalance experiment," *Phys. Rev. B.*, vol. 52, No. 7, 1995, pp. 5318-5322.
Weiss, M. et al., "Dry Friction in the Frenkel-Kontorova-Tomlinson Model: dynamical properties," *Z. Phys. B*, vol. 104, 1997, pp. 55-69.
Weiss, M. et al., "Dry friction in the Frenkel-Kontorova-Tomlinson model: Static properties," *Phys. Rev. B.*, vol. 53, No. 11, 1996, pp. 7539-7549.
Yang, Y. T. et al., "Monocrystalline silicon carbide nanoelectromechanical systems," *Applied Physics Lett.*, vol. 78, No. 2, 2001, pp. 162-164.
Yoshizawa, H. et al., "Fundamental Mechanisms of Interfacial Friction. 2. Stick-Slip Friction of Spherical and Chain Molecules," *The Journal of Physical Chemistry B.*, vol. 97, No. 43, 1993, pp. 11300-11313.
Yoshizawa, H. et al., "Identification of a Second Dynamic State During Stick-Slip Motion," *Science*, vol. 259, No. 5099, 1993, pp. 1305-1308.
Zak, M., et al., *From Instability to Intelligence: Complexity and Predictability in Nonlinear Dynamics*, Springer, Berlin, Germany, copyright 1997, pp. 31, 273-276, and 344.
Zaloj, V. et al., "Modifying Friction by Manipulating Normal Response to Lateral Motion," *Phys. Rev. Lett.*, vol. 82, No. 24, 1999, pp. 4823-4826.

* cited by examiner

CONTROL OF FRICTION AT THE NANOSCALE

STATEMENT AS TO RIGHTS TO INVENTIONS MADE UNDER FEDERALLY-SPONSORED RESEARCH OR DEVELOPMENT

This invention was made with United States Government support under prime contract No. DE-AC05-00OR22725 to UT-Battelle, L.L.C. awarded by the Department of Energy. The Government has certain rights in this invention.

BACKGROUND OF THE INVENTION

1. Field of the Invention

The invention relates generally to the field friction control. More particularly, the invention relates to control of friction at the micro and nano scale.

2. Discussion of the Related Art

Despite great progress made during the past half century, many problems in fundamental tribology (such as the origin of friction and failure of lubrication) have remained unsolved. Moreover, the current reliable knowledge related to friction and lubrication is mainly applicable to macroscopic systems and machinery and, most likely, will be only of limited use for micro-and nano-systems. Indeed, when the thickness of the lubrication film is comparable to the molecular or atomic size, the behavior of the (film) lubricant becomes significantly different from the behavior of macroscopic (bulk) lubricant [1]. Better understanding of the intimate mechanisms of friction, lubrication, and other interfacial phenomena at the atomic and molecular scales is needed to provide designers and engineers the required tools and capabilities to monitor and control friction, reduce unnecessary wear, and predict mechanical faults and failure of lubrication in micro-electro-mechanical systems (MEMS) and nano-devices [2].

The ability to control and manipulate friction during sliding is extremely important for a large variety of technological applications. The outstanding difficulties in realizing efficient friction control are related to the complexity of the task, namely dealing with systems with many degrees of freedom under strict size confinement, and only very limited control access. Moreover, a nonlinear system driven far from equilibrium may exhibit a variety of complex spatial and temporal behaviors, each resulting in different patterns of motion and corresponding to different friction coefficient [3].

Friction can be manipulated by applying small perturbations to accessible elements and parameters of a sliding system [4-10]. Usually, these control methods are based on non-feedback controls. Recently, the groups of J. Israelachvili [4] (experimental) and U. Landman [5] (full-scale molecular dynamics computer simulation) showed that friction in thin-film boundary lubricated junctions can be reduced by coupling small amplitude (of the order of 1 Å) directional mechanical oscillations of the confining boundaries to the molecular degree of freedom of the sheared interfacial lubricating fluid. Using a surface force apparatus, modified for measuring friction forces while simultaneously inducing normal (out-of-plane) vibrations between two boundary-lubricated sliding surfaces, load- and frequency-dependent transitions between a number of "dynamical friction" states have been observed [4]. In particular, regimes of vanishingly small friction at interfacial oscillations were found. Extensive grand-canonical molecular dynamics simulations [5] revealed the nature of the dynamical states of confined sheared molecular films, their structural mechanisms, and the molecular scale mechanisms underlying transitions between them. Methods to control friction in systems under shear that begin to enable the elimination of chaotic stick-slip motion were proposed by Rozman et al [6]. Significant changes in frictional responses were observed in the two-plate model [7] by modulating the normal response to lateral motion [8]. In addition, the surface roughness and the thermal noise are expected to play a significant role in deciding control strategies at the micro and the nano-scale [9, 10].

Since feedback control methods require specific knowledge of the strength and timing of the perturbations, their application to nano-friction has been very limited. On the other hand, feedback control methods (e.g., proportional feedback) have been applied extensively in many engineering fields. All these feedback controls have been Lipschitzian. Recently, non-Lipschitzian (terminal attractor based) feedback control has been successfully implemented in first order systems such as neural networks [11, 12].

Despite their relative simplicity, phenomenological models of friction at the atomic level [10, 13-16] show a fair agreement with many experimental results using either friction force equipment [7, 18, 19] or quartz microbalance experiments [9, 17, 20]. The basic equations for the driven dynamics of a one dimensional particle array of N identical particles moving on a surface are given by a set of coupled nonlinear equations of the form [16]:

$$m\ddot{x}_j+\gamma\dot{x}_j=-\partial U/\partial x_j-\partial V/\partial x_j+f_j+\eta(t),\ j=1,\ldots N \tag{1}$$

where $x_j$ is the coordinate of the $j^{th}$ particle, m is its mass, $\gamma$ is the linear friction coefficient representing the single particle energy exchange with the substrate, $f_j$ is the applied external force, and $\eta(t)$ is Gaussian noise. The particles in the array are subjected to a periodic potential, $U(x_j+a)=U(x_j)$, and interact with each other via a pair-wise potential $V(x_j-x_i)$, j, i=1, 2, . . . N. A system represented by Equation (1) provides a general framework of modeling friction although the amount of detail and complexity varies in different studies from simplified one dimensional models [15, 16, 21, 22] through two dimensional and three dimensional models [17, 23, 24, 25] to a full set of molecular dynamics simulations [25, 26].

Phenomenological models of friction at the atomic level can include the following simplifications (assumptions): (i) the substrate potential is a simple periodic form, (ii) there is a zero misfit length between the array and the substrate, (iii) the same force $f$ is applied to each particle, and (iv) the interparticle coupling is linear. The coupling with the substrate is, however, strongly nonlinear. For this case, using the dimensionless phase variables $\phi_j=2\pi x_j/a$, the equation of motion reduces to the dynamic Frenkel-Kontorova model [16]

$$\ddot{\phi}_j+\gamma\dot{\phi}_j+\sin(\phi_j)=f+\kappa(\phi_{j+1}-2\phi_j+\phi_{j-1}). \tag{2}$$

Without control, Equation (2) exhibits four different regimes: (i) rest (no motion), (ii) periodic sliding, (iii) periodic stick-slip, and (iv) chaotic stick-slip. Different motion types are obtained by only changing the initial conditions of the particle's positions and velocities, but not the system's parameters. The average velocity of the center of mass for the "natural" (i.e., uncontrolled) motion, may take only a limited range of values, namely: (i) v=0 for rest (no sliding), (ii) $v=f/\gamma$ for periodic sliding motion, and (iii) $v=nv_0$, where n is an integer, $$v_0=\frac{2\pi}{nN\gamma}\sqrt{\frac{\pi-\cos^{-1}f}{\pi}(\kappa-\kappa_c)^{1/2}},$$

for periodic stick-slip motion, [16].

SUMMARY OF THE INVENTION

There is a need for the following aspects of the invention. Of course, the invention is not limited to these aspects.

According to an aspect of the invention, a process comprises: controlling frictional dynamics of a plurality of particles using non-Lipschitzian feedback control including: measuring a property of the plurality of particles; calculating a velocity of the plurality of particles as a function of the property; calculating a velocity deviation by subtracting the velocity of the plurality of particles from a target velocity; calculating a non-Lipschitzian (terminal attractor based) feedback control term by raising the velocity deviation to a fractionary power $\xi=(2m+1)/(2n+1)$ where n=1, 2, 3 . . . and m=0, 1, 2, 3 . . . , with m strictly less than n and then multiplying by a control amplitude; and imposing the non-Lipschitzian (terminal attractor based) feedback control term globally on each of the plurality of particles, wherein imposing causes a subsequent magnitude of the velocity deviation to be reduced. According to another aspect of the invention, a method comprises controlling frictional dynamics of a plurality of particles using non-Lipschitzian feedback control including determining an attribute of the plurality of particles; calculating an attribute deviation by subtracting the attribute of the plurality of particles from a target attribute; calculating a non-Lipschitzian feedback control term by raising the attribute deviation to a fractionary power $\xi=(2m+1)/(2n+1)$ where n=1, 2, 3 . . . and m=0, 1, 2, 3 . . . , with m strictly less than n and then multiplying by a control amplitude; and imposing the non-Lipschitzian feedback control term globally on each of the plurality of particles, wherein imposing causes a subsequent magnitude of the attribute deviation to be reduced. According to another aspect of the invention, an apparatus comprises a general dynamic system including a plurality of particles and a global feedback system that controls an attribute of the plurality particles using non-Lipschitzian control, including a characterization instrument that determines the attribute of the plurality of particles; a logic module that calculates I) an attribute deviation by subtracting the attribute of the plurality of particles from a target attribute value and II) a non-Lipschitzian feedback control term by raising the attribute deviation to a fractionary power $\xi=(2m+1)/(2n+1)$ where n=1, 2, 3 . . . and m=0, 1, 2, 3 . . . , with m strictly less than n and then multiplying by a control amplitude; and a tool that imposes the non-Lipschitzian feedback control term globally on each of the plurality of particles of the inertial dynamic system, wherein a subsequent magnitude of the attribute deviation is reduced. According to another aspect of the invention, a process comprises: controlling an attribute of a plurality of members of a general dynamic system using non-Lipschitzian control including: determining an attribute of the plurality of members; calculating an attribute deviation by subtracting the attribute of the plurality of members from a target attribute value; calculating a terminal attractor based control term by raising the attribute deviation to a fractionary power $\xi=(2m+1)/(2n+1)$ where n=1, 2, 3 . . . and m=0, 1, 2, 3 . . . , with m strictly less than n and then multiplying by a control amplitude; and imposing the terminal attractor based control term globally on each of the plurality of members of the inertial dynamic system, wherein imposing causes a subsequent magnitude of the attribute deviation to be reduced. According to another aspect of the invention, a machine comprises: a general dynamic system including a plurality of members; and a global feedback system that controls an attribute of the plurality members using non-Lipschitzian control, including: a characterization instrument that determines the attribute of the plurality of members; a logic module that calculates I) an attribute deviation by subtracting the attribute of the plurality of members from a target attribute value and II) a terminal attractor based control term by raising the attribute deviation to a fractionary power $\xi=(2m+1)/(2n+1)$ where n=1, 2, 3 . . . and m=0, 1, 2, 3 . . . , with m strictly less than n and then multiplying by a control amplitude; and a tool that imposes the terminal attractor based control term globally on each of the plurality of members of the inertial dynamic system, wherein a subsequent magnitude of the attribute deviation is reduced.

These, and other, aspects of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore nonlimiting, embodiments illustrated in the drawings. The invention may be better understood by reference to one or more of these drawings in combination with the description presented herein. It should be noted that the features illustrated in the drawings are not necessarily drawn to scale.

DESCRIPTION OF PREFERRED EMBODIMENTS

Figure 1:
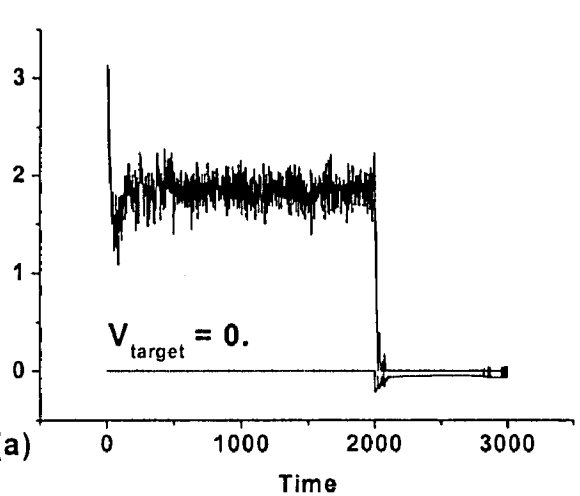
FIGS. 1A-1D illustrate performance of the invention in the context of friction control with respect to four different target velocities by plotting the velocity of the center of mass of a plurality of particles as a function of time, together with (in each of the four cases) an imposed target, representing embodiments of the invention.
Figure 1:
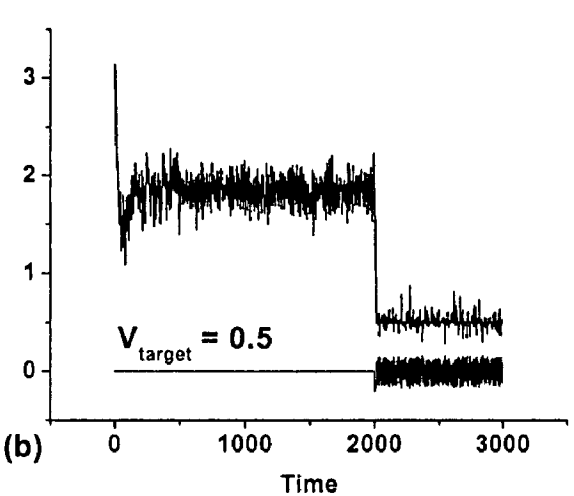
Figure 1:
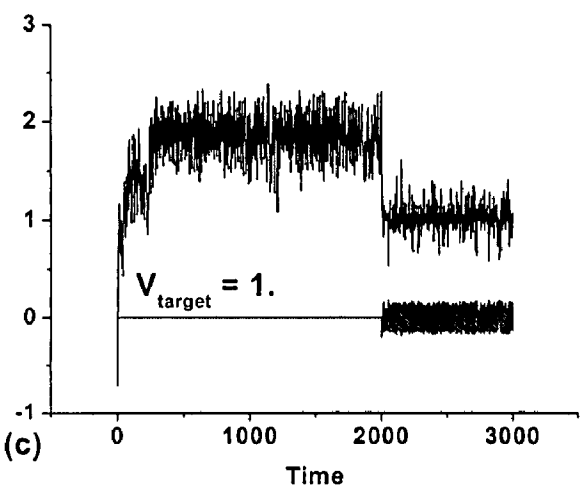
Figure 1:
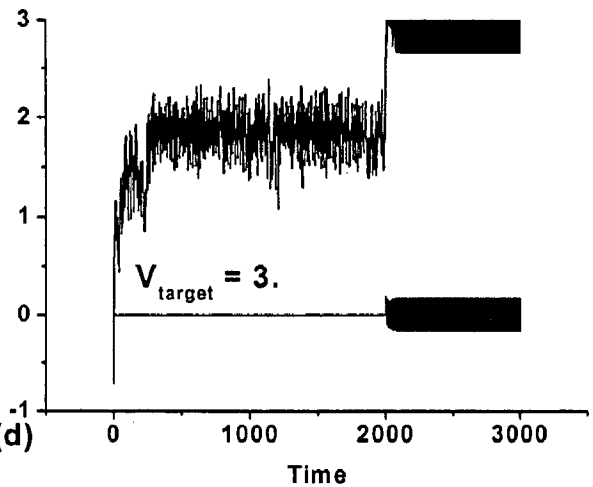

The invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Within this application several publications are referenced by Arabic numerals within brackets. Full citations for these, and other, publications may be found at the end of the specification immediately preceding the claims after the section heading References. The disclosures of all these publications in their entireties are hereby expressly incorporated by reference herein for the purpose of indicating the background of the invention and illustrating the state of the art.

The invention can include a method (and/or apparatus based on the method) to control a dynamic attribute of a plurality of structures toward a pre-assigned (pre-determined) value or variable behavior of that attribute. The control of the dynamic attribute can be based on the concepts of non-Lipschitzian dynamics and the use of a non-Lipschitzian global feedback control term. Optionally, the invention can include maintaining the control until the deviation is reduced to zero whereupon the target has been reached. In a preferred embodiment, the invention can include a method (and/or apparatus based on the method) to control sliding and frictional properties (such as friction coefficient, friction force, sliding velocity, slip time) of a plurality (e.g., array) of atoms and/or molecules towards a pre-assigned (pre-determined) value of a target (average sliding velocity, slip time, friction coefficient and friction force). The invention can also include a method (and/or apparatus based on the method) to control shear forces and static forces, viscosity, and adhesion forces towards a pre-assigned value of a target (shear and static forces, viscosity, and adhesion forces). The invention can also include a method (and/or apparatus based on the method to control sliding trajectory, speed, direction and diffusion of atomic and molecular chains and polymers sliding on surfaces towards a pre-assigned value of a target (sliding trajectory, speed direction and diffusion coefficient). Implementation of the non-Lipschitzian friction control technique is applicable but not limited for slip time and velocity control in a quartz micro balance apparatus, friction coefficient and friction force control in an atomic force microscope, and friction forces, loss and elastic moduli control in a surface force apparatus. Implementation of non-Lipschitzian control algorithm can be achieved either through imposing controlled vibrations of the sliding surfaces and/or the AFM tip (normal and/or in-plane) or electromechanical, electro-optical, or optical excitations applied to the sliding system and/or the lubricant according to the proposed algorithm. Implementation of control algorithm can be also achieved by imposing controlled vibrations of the sliding surfaces with a surface force apparatus, a quartz microbalance and/or using cantilevers and/or cantilever arrays. In addition, electromechanical, electro-optical, and optical control can be utilized in conjunction with (applicable for) all the previously described friction measurement apparatuses. As in the generic case, this control can be based on the concepts of non-Lipschitzian dynamics and the use of a (terminal attractor based) non-Lipschitzian global feedback control term. Extensive numerical simulations, some of which are described below, have actually proven the robustness, efficiency, and convenience of the invention applied in the context of controlling friction.

Non-Lipschitzian (terminal attractor based) global control feedback is an important aspect of the invention and provides several advantages. First, the presence of a terminal attractor in the control term provides robustness and ensures very fast approach to target. Second, the global control turns out to be more efficient and easier to implement compared to non-global control. Fast time scales and ease of implementation make the invention a very suitable tool for phenomena in nanoscale systems where accessibility is an issue (as in friction, for instance). However, the applicability of the invention is quite general.

This preferred embodiment of the invention can include an algorithm to control friction of sliding nano-arrays. This algorithmic control can be based on the concept of a terminal attractor and is global in that: (i) it can require only knowledge of the velocity of the center of mass and (ii) it can be applied globally to the all members of the plurality of particles (e.g., the whole array).

The inventors have already demonstrated the efficiency and robustness of the control by reaching a broad spectrum of target velocities—both close to or far from natural attractors—in very short transient times. Extensive numerical simulations have been performed on arrays of different sizes ($3<N<256$) in order to verify that size effects are not critical for the inventive control. The numerical and graphical results of some of these numerical simulations are presented in FIGS. 1A-1D and FIG. 2 for a typical one-dimensional nano-array of N=15 particles.

In this preferred embodiment, the velocity of the particles (e.g., average sliding, center of mass velocity of an array of nanoparticles) can be measured using a quartz crystal microbalance. The control term can be imposed on each of the plurality of particles via an optical pulse (e.g., from a tuned laser). The optical pulse can define a spot (having a size and flux density) that is sufficiently large and uniform to evenly impose the control term on each of the plurality of particles. In this case, the optical pulse intensity and its duration should be controlled electronically via the control term which can be provided as an input signal to the electronics. A plurality of such optical pulses over time can in-turn define a duty cycle.

In an alternative embodiment, the invention can include a method (and/or apparatus based on the method) to control intensity, phase, (e.g., synchronized array) of lasers towards a pre-assigned (pre-determined) value of a target intensity and/or target phases. Again, this control can be based on the concepts of non-Lipschitzian dynamics and the use of a non-Lipschitzian (terminal attractor based) global feedback control term.

In this alternative embodiment, the intensity and/or phases of the lasers can be measured using a charge coupled device. The control term can be imposed on each of the plurality of lasers via electronics or optics that are provided with the control term as an input signal to the electronics.

It is important to appreciate that the invention can address fundamental issues related to targeting and control of an attribute of a dynamic system (e.g., friction in nanoscale driven nonlinear particle arrays, synchronization of laser arrays, etc.), by using the global feedback control approach that is based on the properties of terminal attractors. It should be appreciated that the invention can include the application of terminal attractors to second order systems (e.g., friction control, laser synchronization, etc.). It should also be appreciated that the invention can include the feed back of such a non-Lipschitzian feedback control in the context of a second order system, simultaneously, into all state equations, thereby defining a non-Lipschitzian feedback global feedback control.

When applying the control to the nano-array, the inventors' objectives were to: (i) provide the ability to reach a targeted value of the average sliding velocity using only small values of the control; (ii) significantly reduce the transient time needed to reach the desired behavior. To that effect, the invention can include a global feedback control algorithm that uses the concept of a terminal attractor, which is usually associated to non-Lipschitzian dynamics. The equations of motion in the presence of the terminal attractor based control term C(t) read:

$$\ddot{\phi}_j+\gamma\dot{\phi}_j+\sin(\phi_j)=f+\kappa(\phi_{j+1}-2\phi_j+\phi_{j-1})+C(t) \tag{3}$$

where $$C(t)=\alpha(v_{target}-v_{cm})^{\xi} \tag{4}$$

is the non-Lipschitzian control term based on the concept of terminal attractor. In Equation (3), the first term on the left represent the an acceleration of a particle j, the second term on the left represents a velocity of the particle j, the third term on the left represents a position of the particle j, the first term on the right $f$ is a (e.g., ambient) force applied to the particles, the second term on the right represents the interaction between the particle j and its two nearest neighbors j−1 and j+1 (κ is a strength of interaction between a particle of interest and its two nearest neighbors) and the third term on the right represents the non-Lipschitzian feedback (terminal attractor based) control term. In Equation (4), $$v_{cm} = (1/N)\sum_{n=1}^{N} \dot{\phi}_n$$

and represents the average (e.g., center of mass) velocity of the plurality of particles, $v_{target}$ is the targeted (pre-determined) velocity (e.g., for the center of mass of the plurality of particles), α is the control amplitude, ξ=1/(2n+1), and n=1, 2, 3 . . . . More generically, the fractional power can be of the form ξ=1/(2m+1)/(2n+1), where n=1, 2, 3 . . . and m=0, 1, 2, 3 . . . , with m strictly less than n. Preferred embodiments of the invention utilize the fractional power form where the numerator is 1 since these provide enhanced efficiency in practical dynamic implementations.

While most dynamical systems of interest do satisfy the Lipschitz condition, the terminal attractor dynamics that the inventors have discovered is so useful for controlling friction violates it by design. As a result, trajectories reach the terminal attractor in finite time.

To illustrate this phenomenon, consider a simple example of a terminal attractor, namely the equation $\dot{\phi}=-\phi^{1/7}$. At the equilibrium point, φ=0, the Lipschitz condition is violated, since $\partial\dot{\phi}/\partial\phi=-(1/7)\phi^{-6/7}$ tends to minus infinity as φ tends to zero. Thus, the equilibrium point φ=0 is an attractor with "infinite" local stability. p This is precisely the effect realized with the control term C(t). Indeed:

$$\frac{dC}{dv_{cm}} = -(1/7)\alpha(v_{target} - v_{cm})^{-6/7}, \tag{5}$$

i.e., $dC/dv_{cm}\rightarrow-\infty$ as $v_{cm}\rightarrow v_{target}$. It is important to note that the determination (calculation) of the non-Lipschitzian feedback control term requires only knowledge of the average velocity of the plurality of particles (e.g., array), which is an readily (experimentally observable) available quantity. It is also important to note that the non-Lipschitzian feedback control term can be applied identically and concomitantly to all the particles (e.g., in the array) upon which it acts as a uniform force proportional to $(v_{target}-v_{cm})^{\xi}$.

To assess the performance of the invention for more "realistic" interaction potentials, the inventors replaced the linear interaction in Equation (3) by the Morse interaction:

$$F_j = \frac{\gamma}{\beta}\{\exp[-\beta(\phi_{j+1} - \phi_j)] - \exp[-2\beta(\phi_{j+1} - \phi_j)]\} - \frac{\gamma}{\beta}\{\exp[-\beta(\phi_j - \phi_{j-1})] - \exp[-2\beta(\phi_j - \phi_{j-1})]\}.$$

The inventors' simulations indicate that the control algorithm remains robust and efficient. As already mentioned, the inventors also performed preliminary simulations for arrays as large as N=256. The outcome is comparable to the results presented here, which suggests that the invention remains efficient in systems larger than the atomic size.

Figure 2:
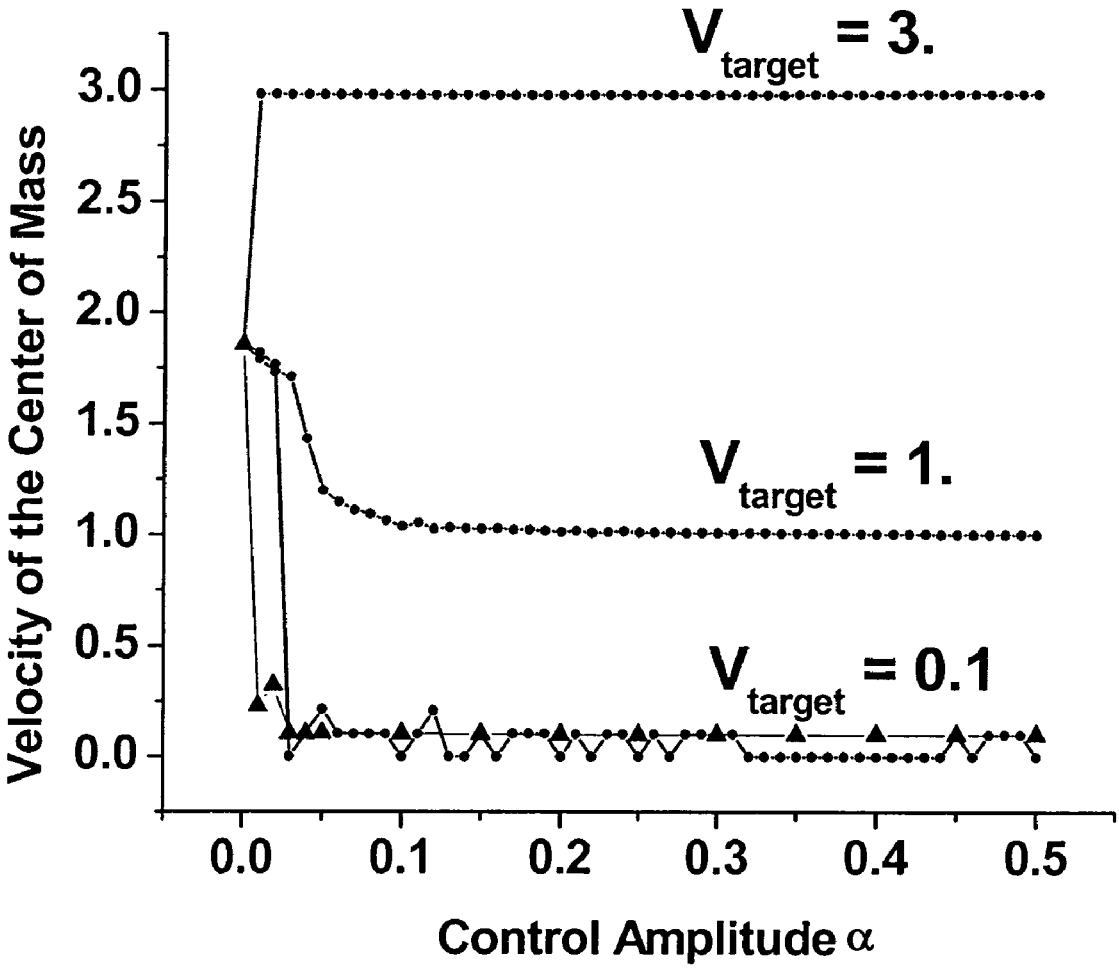
FIG. 2 illustrates performance of the invention in the context of friction control with respect to four different examples by plotting the velocity of the center of mass of a plurality of particles as a function of the magnitude of the control amplitude, $\alpha$, for three different targets, representing embodiments of the invention.

Experimental results are presented in FIGS. 1A-1D and FIG. 2 for ξ=1/7, but the invention performs equally well for other values such as 1/3, 1/5 and 1/9, 1/11 . . . . FIG. 2 plots the center of mass velocity as a function of the maximum control amplitude α. The inventors chose three values of the target velocity, namely 0.1 (bottom), 1.0 (middle), and 3.0 (top). The triangles show the velocity of center of mass for control defined by Equation 6. All the parameters are the same as in FIG. 1 and initial conditions were chosen randomly.

The inventors performed extensive testing of the embodiment of the invention represented by (Equations 3-4) by choosing numerous values of the target velocity. At the target itself, the non-Lipschitzian terminal attractor has "infinite attraction power", which endows the invention with excellent efficiency and robustness, as illustrated in FIGS. 1A-1D for four values of the target velocity, namely: $v_{target}$=0, 0.2, 1 and 3. Referring to FIGS. 1A-1D, the bottom traces (red color lines) indicate the time series of the control (Equation 4), while the top traces (blue color lines) show the time series of the velocity of the center of mass. In all cases, the inventors reached and sustained the (arbitrarily chosen) target values for rather small values of the control. Thus, FIGS. 1A-1D illustrate performance of the control algorithm. The inventors picked four values of the target velocities: $v_{target}$=0 (FIG. 1A), 0.5 (FIG. 1B), 1.0 (FIG. 1C), and 3.0 (FIG. 1D) for an N=15 particle array. Control was initiated at t=2000. In all of FIGS. 1A-1D, the top traces (blue lines) show time series of the center of mass velocities while the bottom traces (red lines) show the control. It is significant and important to note that in all cases, the desired behavior was achieved. The other parameters are: $f$=0.3, γ=0. 1, κ=0.26, and ξ=1/7. All the units are dimensionless and the initial conditions can be chosen randomly. The inventors applied the control at the time t=2000. All the results shown in FIGS. 1A-1D clearly indicate that with a very short transient time: convergence is very fast and the strength of the control is small.

FIG. 2 illustrates the performance of the algorithm for different values of the target velocities as a function of the parameter α (see Equation 3). The inventors chose random set of initial conditions for each value of the parameter α. Indeed, fo$_r$ most target values the convergence to the target value is straightforward (see upper and middle curves). However, for a few values of $v_{target}$, the dependence of the center of mass velocity, $v_{cm}$ on α turned out to be more irregular. These are the cases where the targeted values of the average velocities are in close proximity with those values without control (i.e. the desired behavior is in the vicinity of natural attractors of the uncontrolled array). Thus, the inventors modified the control as follows:

$$C(t)=\alpha(v_{target}-v_{cm})^{\xi}-\beta(v_{av}-v_{cm})^{\xi}\mathrm{sgn}[(v_{av}-v_{cm})(v_{cm}-v_{target})]H[r-|v_{target}-v_{av}|]. \tag{6}$$

The second term in Equation (6) represents a repelling from a possible natural attractor of system (3) that would deflect the trajectory towards itself and away from the target velocity, $v_{target}$. In general, the natural attractors are not known analytically and/or a priori. Their presence is indicated only by the behavior of the system and accounted for by $v_{av}$, which is the "running" (time dependent) average velocity and represents the moving run-time average of $v_{cm}$. H(.) denotes a Heaviside function, defined as H(z)=1 for z>0, and H(z)=0 for z<0. The Heaviside function can be further defined as H(z)=1 for z=0 or as H(z)=0 for z=0. The role of this Heaviside function is to activate the terminal repeller only within a neighborhood of radius r from the natural attractor. The radius r can be termed a threshold. The coefficients $\alpha$ and $\alpha$ are positive numbers that represent the weights of the non-Lipschitzian attractor and repeller, respectively.

The inventors applied the algorithm to the target the value of v=0.1 (see the bottom curve in FIG. 2). Here, the inventors are close to the static solution (stable fixed point) v=0. Therefore, for some values of the control amplitude $\alpha$, the outcome average velocity is v=0 (instead of the desired velocity v=0.1). The triangles in FIG. 2 shows the center of mass velocity as a function of a but using control defined in Equation 6. This control will repel the fixed point of v=0, therefore the inventors observe even better performance of the invention.

Practical Applications of the Invention

A practical application of the invention that has value within the technological arts is as an efficient tool for controlling friction between a plurality of particles and a surface, between sliding surfaces and between sliding surfaces and a lubricant. The invention is applicable to quartz microbalance, atomic force microscope, and surface force apparatus-type experiments. The invention is also applicable to cantilevers and arrays of cantilevers, and in particular to micro-electromechanical systems (MEMS) where frictional contact and resulting wear are important factors in their design. The invention is also applicable to fast controls such as optical, or usage of micro/nano cantilevers. The invention is also applicable to implementations at time scales slower than the characteristic times of the dynamical system. Indeed, numerical simulations show that the control can be applied at much slower rates, while still maintaining the average value of the velocity close to the target. The "price" of such relaxed requirements are that longer times are needed to reach the target and larger fluctuations from the averaged value are observed. Another practical application of the invention is as a tool for synchronizing a plurality of lasers. There are virtually innumerable uses for the invention, all of which need not be detailed here.

The terms a or an, as used herein, are defined as one or more than one. The term plurality, as used herein, is defined as two or more than two. The term another, as used herein, is defined as at least a second or more. The terms "comprising" (comprises, comprised), "including" (includes, included) and/or "having" (has, had), as used herein, are defined as open language (i.e., requiring what is thereafter recited, but open for the inclusion of unspecified procedure(s), structure(s) and/or ingredient(s) even in major amounts. The terms "consisting" (consists, consisted) and/or "composing" (composes, composed), as used herein, close the recited method, apparatus or composition to the inclusion of procedures, structure(s) and/or ingredient(s) other than those recited except for ancillaries, adjuncts and/or impurities ordinarily associated therewith. The recital of the term "essentially" along with the terms "consisting" or "composing" renders the recited method, apparatus and/or composition open only for the inclusion of unspecified procedure(s), structure(s) and/or ingredient(s) which do not materially affect the basic novel characteristics of the composition. The term coupled, as used herein, is defined as connected, although not necessarily directly, and not necessarily mechanically. The term approximately, as used herein, is defined as at least close to a given value (e.g., preferably within 10% of, more preferably within 1% of, and most preferably within 0.1% of). The term substantially, as used herein, is defined as largely but not necessarily wholly that which is specified. The term generally, as used herein, is defined as at least approaching a given state. The term deploying, as used herein, is defined as designing, building, shipping, installing and/or operating. The term means, as used herein, is defined as hardware, firmware and/or software for achieving a result. The term program or phrase computer program, as used herein, is defined as a sequence of instructions designed for execution on a computer system. A program, or computer program, may include a subroutine, a function, a procedure, an object method, an object implementation, an executable application, an applet, a servlet, a source code, an object code, a shared library/dynamic load library and/or other sequence of instructions designed for execution on a computer or computer system.

All the disclosed embodiments of the invention disclosed herein can be made and used without undue experimentation in light of the disclosure. The invention is not limited by theoretical statements recited herein. Although the best mode of carrying out the invention contemplated by the inventor(s) is disclosed, practice of the invention is not limited thereto. Accordingly, it will be appreciated by those skilled in the art that the invention may be practiced otherwise than as specifically described herein.

It will be manifest that various substitutions, modifications, additions and/or rearrangements of the features of the invention may be made without deviating from the spirit and/or scope of the underlying inventive concept. It is deemed that the spirit and/or scope of the underlying inventive concept as defined by the appended claims and their equivalents cover all such substitutions, modifications, additions and/or rearrangements.

All the disclosed elements and features of each disclosed embodiment can be combined with, or substituted for, the disclosed elements and features of every other disclosed embodiment except where such elements or features are mutually exclusive. Variation may be made in the steps or in the sequence of steps defining methods described herein. Although the global feedback system described herein can be a separate module, it will be manifest that the global feedback system may be integrated into the meta-system with which it is associated.

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

REFERENCES

[1] Y. Z. Hu and S. Granick, Tribol. Lett., 5, 81 (1998).

[2] H. Fujita in Proceedings IEEE, Tenth Annual International Workshop on Micro Electro Mechanical Systems, Published by: IEEE Robotics and Control Division Div., New York, N.Y. (1997). Brushan, in Proceedings IEEE, The Ninth Annual International Workshop in Micro Electro Mechanical Systems, Published by: IEEE Robotics & Autom. Soc. IEEE, New York, N.Y. (1996).

[3] H. G. E. Hentschel, F. Family, and Y. Braiman, Phys. Rev. Lett., 83, 104 (1999).

[4] M. Heuberger, C. Drummond, and J. Israelachvili, J. Phys. Chem. B 102, 5038 (1998).

[5] J. P. Gao, W. D. Luedtke, and U. Landman, J. Phys. Chem. B, 102, 5033 (1998).

[6] M. G. Rozman, M. Urbakh, and J. Klafter, Phys. Rev. E 57, 7340 (1998).

[7] M. G. Rozman, M. Urbakh, and J. Klafter, Phys. Rev. Lett., 77, 683 (1996), and Phys. Rev. E 54, 6485 (1996).

[8] V. Zaloj, M. Urbakh, and J. Klafter, Phys. Rev. Lett., 82, 4823 (1999).

[9] Y. Braiman, F. Family, H. G. E. Hentschel, C. Mak, and J. Krim, Phys. Rev. E, 59, R4737 (1999).

[10] J. P. Gao, W. D. Luedtke, and U. Landman, Tribol. Lett., 9, 3 (2000).

[11] J. Barhen, S. Gulati, and M. Zak, IEEE Computer, 22(6), 67 (1989).

[12] M. Zak, J. Zbilut, and R. Meyers, *From Instability to Intelligence,* Springer (1997).

[13] J. M. Carlson and A. A. Batista, Phys. Rev E, 53, 4153 (1996).

[14] A. A. Batista and J. M. Carlson, Phys. Rev. E, 57, 4986 (1998).

[15] B. N. J. Persson, Phys. Rev. B 55, 8004 (1997).

[16] Y. Braiman, F. Family, and H. G. E. Hentschel, Phys. Rev. B, 55, 5491 (1997), and Phys. Rev. E, 53, R3005 (1996).

[17] B. N. J. Persson and A. Nitzan, Surface Science 367, 261 (1996).

[18] G. Reiter, A. L. Demirel, and S. Granick, Science 263, 1741 (1994); A. L. Demirel and S. Granick, Phys. Rev. Lett., 77, 4330 (1996).

[19] H. Yoshizava, P. McGuiggan, and J. Israelachvili, Science, 259, 1305 (1993); H. Yoshizava and J. Israelachvili, J. Phys. Chem. 97, 11300 (1993).

[20] C. Daly and J. Krim, Phys. Rev. Lett., 76, 803 (1996); C. Mak and J. Krim, Phys. Rev. B, 58, 5157 (1998).

[21] B. N. J. Persson, Phys. Rev. B, 48, 18140 (1995), and J. Chem. Phys., 103, 3849 (1997).

[22] F. -J. Elmer, J. Phys. A, 30, 6057 (1997), M. Weiss and F. -J. Elmer, Z. Phys. B, 104, 55 (1997), and Phys. Rev. B, 53, 7539 (1996).

[23] E. D. Smith, M. O. Robbins, and M. Cieplak, Phys. Rev. B, 54, 8252 (1996).

[24] B. J. Sokoloff, Phys. Rev. B, 52, 5318 (1995).

[25] B. Brushan, J. Israelachvili, and U. Landman, Nature, 374, 607 (1995), U. Landman, W. D. Luedtke, and J. P. Gao, Langmuir, 12, 4514 (1996).

[≈] S. Bair, C. McCabe, and P. T. Cummings, Phys. Rev. Lett., 88, 058302 (2002).

[27] Y. T. Yang, K. L. Ekinci, X. M. H. Huang, L. M. Schiavone, and M. L. Roukes, Appl. Phys. Lett., 78, 162 (2001).

[28] J. Barhen, Y. Y. Braiman, and V. A. Protopopescu, *Control of Friction at the Nanoscale,* Physical Review Letters, 90, No. 9, pages 094301-1 through 094301-4 (Mar. 5, 2003).

What is claimed is:

1. A method, comprising controlling frictional dynamics of a plurality of separate individual particles using non-Lipschitzian feedback control including:

measuring a property of the plurality of separate individual particles;

calculating a velocity of the plurality of separate individual particles as a function of the property, the velocity of the plurality of separate individual particles being a center of mass velocity $$V_{cm} = (1/N)\sum_{n=1}^{N} \dot{\phi}_n,$$

where N is a total number of the plurality of separate individual particles;

calculating a velocity deviation by subtracting the velocity of the plurality of separate individual particles from a target velocity;

calculating a non-Lipschitzian feedback control term comprising a non-Lipschitzian terminal attractor and a non-Lipschitzian terminal repeller, the terminal attractor being calculated by raising the velocity deviation to a fractionary power $\xi=(2m+1)/(2n+1)$ where n=1, 2, 3 . . . and m=0, 1, 2, 3 . . . , with m strictly less than n and then multiplying by a control amplitude;

calculating a time dependent average velocity $v_{av}$ that represents a moving run-time average of $v_{cm}$, wherein the non-Lipschitzian feedback control term is represented by:

$$C(t)=\alpha(v_{target}-v_{cm})^{\xi}-\beta(v_{av}-v_{cm})^{\xi}\mathrm{sgn}[(v_{av}-v_{cm})(v_{cm}-v_{target})]H[r-|v_{target}-v_{av}|],$$

wherein α is the control amplitude and represents a weight of the non-Lipschitzian terminal attractor, β is another control amplitude and represents another weight of the non-Lipschitzian terminal repeller, H(.) denotes a Heaviside function defined as H(z)=1 for z>0, H(z)=1 for z=0 and H(z)=0 for z<0, r represents a threshold, $v_{target}$ is the target velocity, $v_{target}-v_{cm}$ is the velocity deviation; and imposing the non-Lipschitzian feedback control term globally on each of the plurality of separate individual particles, wherein imposing causes a subsequent magnitude of the velocity deviation to be reduced.

2. The method of claim 1, further comprising repeating the steps of measuring the property of the plurality of separate individual particles, calculating the velocity of the plurality of separate individual particles, calculating the velocity deviation and imposing the non-Lipschitzian feedback control term globally.

3. The method of claim 2, further comprising repeating the steps of calculating the non-Lipschitzian feedback control term to define a recalculated non-Lipschitzian feedback control term and imposing the recalculated non-Lipschitzian feedback control term globally on each of the plurality of separate individual particles.

4. The method of claim 3, wherein repeating the steps of measuring the property of the plurality of separate individual particles, calculating the velocity of the plurality of separate individual particles, calculating the velocity deviation and imposing the non-Lipschitzian feedback control term globally is performed multiple times before repeating the step of calculating the non-Lipschitzian feedback control term to define the recalculated non-Lipschitzian feedback control term and imposing the recalculated non-Lipschitzian feedback control term globally on each of the plurality of separate individual particles.

5. The method of claim 3, wherein periods of controlled and uncontrolled dynamics alternate according to a specified protocol selected from the group consisting of pulsed control and quasi-pulsed control.

6. The method of claim 1, wherein imposing includes coupling an optical pulse to the plurality of separate individual particles.

7. The method of claim 1, wherein the plurality of separate individual particles include an array of nanoparticles.

8. The method of claim 7, wherein the array of nanoparticles includes a one dimensional array of nanoparticles.

9. The method of claim 7, wherein the array of nanoparticles includes a two dimensional array of nanoparticles.

10. The method of claim 1, further comprising changing the control amplitude.

11. The method of claim 1, further comprising changing the target velocity.

12. The method of claim 1, wherein $\xi=1/(2n+1)$ where $n=1, 2, 3 \ldots$ and $dC/dv_{cm}\rightarrow\infty$ as $v_{cm}\rightarrow v_{target}$.

13. The method of claim 1, further comprising changing the another control amplitude.

14. The method of claim 1, further comprising changing a radius.

15. An apparatus, comprising:

a general dynamic system including a plurality of separate individual particles; and a global feedback system that controls an attribute of the plurality of separate individual particles using non-Lipschitzian control, including:

a characterization instrument that determines a velocity of the plurality of separate individual particles, the velocity of the plurality of separate individual particles being a center of mass velocity $$V_{cm} = (1/N)\sum_{n=1}^{N} \dot{\phi}_n,$$

where N is a total number of the plurality of separate individual particles;

a logic module that calculates I) a velocity deviation by subtracting the velocity of the plurality of separate individual particles from a target velocity and II) a non-Lipschitzian feedback control term comprising a non-Lipschitzian terminal attractor and a non-Lipschitzian terminal repeller, the terminal attractor being calculated by raising the velocity deviation to a fractionary power $\xi=(2m+1)/(2n+1)$ where $n=1, 2, 3 \ldots$ and $m=0, 1, 2, 3 \ldots$, with m strictly less than n and then multiplying by a control amplitude; and further calculates a time dependent average velocity $v_{av}$ that represents a moving run-time average of $v_{cm}$, wherein the non-Lipschitzian feedback control term is represented by:

$$C(t)=\alpha(v_{target}-v_{cm})^{\xi}-\beta(v_{av}-v_{cm})^{\xi}\mathrm{sgn}[(v_{av}-v_{cm})(v_{cm}-v_{target})]H[r-|v_{target}-v_{av}|],$$

wherein $\alpha$ is the control amplitude and represents a weight of the non-Lipschitzian terminal attractor, $\beta$ is another control amplitude and represents another weight of the non-Lipschitzian terminal repeller, H(.) denotes a Heaviside function defined as $H(z)=1$ for $z>0$, $H(z)=1$ for $z=0$ and $H(z)=0$ for $z<0$, r represents a threshold, $v_{target}$ is the target velocity, $v_{target}-v_{cm}$ is the velocity deviation; and a tool that imposes the non-Lipschitzian feedback control term globally on each of the plurality of separate individual particles of the inertial dynamic system, wherein a subsequent magnitude of the velocity deviation is reduced.

16. The apparatus of claim 15, wherein the plurality of separate individual particles include a plurality of nanoparticles and the attribute includes at least one member selected from a group consisting of slip time and a frictional force.

17. The apparatus of claim 15, wherein the tool includes a plurality of lasers and the attribute includes at least one member selected from a group consisting of slip time and a frictional force.

18. A method, comprising controlling an attribute of a plurality of separate individual members of a general dynamic system using non-Lipschitzian control including:

determining a velocity of the plurality of separate individual members, the velocity of the plurality of separate individual members being a center of mass velocity $$V_{cm} = (1/N)\sum_{n=1}^{N} \dot{\phi}_n,$$

where N is a total number of the plurality of separate individual members;

calculating a velocity deviation by subtracting the velocity of the plurality of separate individual members from a target velocity;

calculating a non-Lipschitzian feedback control term comprising a non-Lipschitzian terminal attractor and a non-Lipschitzian terminal repeller, the terminal attractor being calculated by raising the velocity deviation to a fractionary power $\xi=(2m+1)/(2n+1)$ where $n=1, 2, 3 \ldots$ and $m=0, 1, 2, 3 \ldots$, with m strictly less than n and then multiplying by a control amplitude, and further calculating a time dependent average velocity $v_{av}$ that represents a moving run-time average of $v_{cm}$, wherein the non-Lipschitzian feedback control term is represented by:

$$C(t)=\alpha(v_{target}-v_{cm})^{\xi}-\beta(v_{av}-v_{cm})^{\xi}\mathrm{sgn}[(v_{av}-v_{cm})(v_{cm}-v_{target})]H[r-|v_{target}-v_{av}|],$$

wherein $\alpha$ is the control amplitude and represents a weight of the non-Lipschitzian terminal attractor, $\beta$ is another control amplitude and represents another weight of the non-Lipschitzian terminal repeller, H(.) denotes a Heaviside function defined as $H(z)=1$ for $z>0$, $H(z)=1$ for $z=0$ and $H(z)=0$ for $z<0$, r represents a threshold, $v_{target}$ is the target velocity $v_{target}-v_{cm}$ is the velocity deviation; and imposing the non-Lipschitzian feedback control term globally on each of the plurality of separate individual members of the general dynamic system, wherein imposing causes a subsequent magnitude of the attribute deviation to be reduced.

19. The method of claim 18, further comprising repeating the steps of determining the attribute of the plurality of separate individual members, calculating the attribute deviation, calculating the non-Lipschitzian feedback control term to define a recalculated non-Lipschitzian feedback control term and imposing the recalculated non-Lipschitzian feedback control term globally on each of the plurality of separate individual members.

20. The method of claim 19, wherein repeating the steps of determining the attribute of the plurality of separate individual members, calculating the attribute deviation and imposing the non-Lipschitzian feedback control term globally is performed multiple times before repeating the steps of calculating the non-Lipschitzian feedback control term to define the recalculated non-Lipschitzian feedback control term and imposing the recalculated non-Lipschitzian feedback control term globally on each of the plurality of separate individual members.

21. The method of claim 19, wherein periods of controlled and uncontrolled dynamics alternate according to a specified protocol selected from a group consisting of pulsed control and quasi-pulsed control.

22. The method of claim 18, wherein the plurality of separate individual members include a plurality of nanoparticles and the attribute includes at least one member selected from a group consisting of an average sliding velocity, slip time and frictional force.

23. The method of claim 18, wherein imposing includes using a plurality of lasers and the attribute includes at least one member selected from a group consisting of intensity and phase.

24. An apparatus, comprising:

a general dynamic system including a plurality of separate individual members; and a global feedback system that controls an attribute of the plurality of separate individual members using non-Lipschitzian control, including:

a characterization instrument that determines the attribute of the plurality of separate individual members;

a logic module that calculates I) a velocity deviation by subtracting a velocity of the plurality of separate individual members from a target velocity, the velocity of the plurality of separate individual members being a center of mass velocity $$V_{cm} = (1/N)\sum_{n=1}^{N} \dot{\phi}_n,$$

where N is a total number of the plurality of separate individual members; and II) a non-Lipschitzian feedback control term comprising a non-Lipschitzian terminal attractor and a non-Lipschitzian terminal repeller the terminal attractor being calculated by raising the velocity deviation to a fractionary power $\xi=(2m+1)/(2n+1)$ where n=1, 2, 3 . . . and m=0, 1, 2, 3 . . . , with m strictly less than n and then multiplying by a control amplitude; and further calculates a time dependent average velocity $v_{av}$ that represents a moving run-time average of $v_{cm}$, wherein the non-Lipschitzian feedback control term is represented by:

$$C(t)=\alpha(v_{target}-v_{cm})^{\xi}-\beta(v_{av}-v_{cm})^{\xi}\mathrm{sgn}[(v_{av}-v_{cm})(v_{cm}-v_{target})]H[r-|v_{target}-v_{av}|],$$

wherein $\alpha$ is the control amplitude and represents a weight of the non-Lipschitzian terminal attractor, $\beta$ is another control amplitude and represents another weight of the non-Lipschitzian terminal repeller, H(.) denotes a Heaviside function defined as H(z)=1 for z>0, H(z)=1 for z=0 and H(z)=0 for z<0, r represents a threshold, $v_{target}$ is the target velocity, $v_{target}-v_{cm}$ is the velocity deviation; and a tool that imposes the non-Lipschitzian feedback control term globally on each of the plurality of separate individual members of the inertial dynamic system, wherein a subsequent magnitude of the attribute deviation is reduced.

25. The apparatus of claim 24, wherein the plurality of separate individual members include a plurality of nanoparticles and the attribute includes at least one member selected from a group consisting of an average sliding velocity, slip time and a frictional force.

26. The apparatus of claim 24, wherein the tool includes a plurality of lasers and the attribute includes at least one member selected from a group consisting of intensity and phase.

* * * * *